US008602118B2

(12) United States Patent
Pigeon

(10) Patent No.: US 8,602,118 B2
(45) Date of Patent: Dec. 10, 2013

(54) FIRE SPRINKLER

(76) Inventor: Jeffrey Pigeon, Novi, MI (US)

( * ) Notice: Subject to any disclaimer, the term of this patent is extended or adjusted under 35 U.S.C. 154(b) by 0 days.

(21) Appl. No.: 12/109,221

(22) Filed: Apr. 24, 2008

(65) Prior Publication Data

US 2008/0202773 A1 Aug. 28, 2008

Related U.S. Application Data

(63) Continuation-in-part of application No. PCT/US2006/025278, filed on Jun. 27, 2006.

(51) Int. Cl.

| | |
|---|---|
| ***A62C 37/14*** | (2006.01) |
| ***A62C 37/11*** | (2006.01) |
| ***A62C 37/08*** | (2006.01) |
| ***B05B 1/26*** | (2006.01) |

(52) U.S. Cl.
USPC ..... 169/37; 169/58; 239/524; 239/DIG. 1

(58) Field of Classification Search
USPC ..... 169/16, 17, 37, 54, 58, 41, 56, 57; 239/499, 500, 518, 523, 524, DIG. 1
See application file for complete search history.

(56) References Cited

U.S. PATENT DOCUMENTS

| | | | | |
|---|---|---|---|---|
| 241,000 | A | 5/1881 | Granger | |
| 269,205 | A | 12/1882 | Grinnell | |
| 269,226 | A | 12/1882 | Parmelee | |
| 344,673 | A | 6/1886 | Neracher | |
| 726,200 | A * | 4/1903 | Stover | 169/57 |
| 1,667,425 | A * | 4/1928 | Loepsinger | 169/5 |
| 2,025,063 | A | 12/1935 | Loepsinger | |
| 2,046,169 | A * | 6/1936 | Knight | 239/504 |
| 2,862,565 | A * | 12/1958 | Dukes | 169/38 |
| 3,924,687 | A * | 12/1975 | Groos | 169/19 |
| 4,585,069 | A | 4/1986 | Whitaker | |
| 4,834,186 | A | 5/1989 | Ballard | |
| 5,579,846 | A | 12/1996 | Meyer | |
| 5,584,344 | A | 12/1996 | Meyer | |
| 5,609,211 | A | 3/1997 | Meyer | |
| 5,628,367 | A * | 5/1997 | Truax et al. | 169/37 |
| 5,630,551 | A * | 5/1997 | Forcier | 239/563 |
| 5,669,449 | A * | 9/1997 | Polan et al. | 169/16 |
| 5,687,914 | A | 11/1997 | Bosio | |
| 5,727,737 | A * | 3/1998 | Bosio et al. | 239/504 |
| 5,862,994 | A * | 1/1999 | Pounder et al. | 239/498 |
| 5,865,256 | A | 2/1999 | Pounder | |
| 6,059,044 | A * | 5/2000 | Fischer | 169/37 |
| 6,374,920 | B1 * | 4/2002 | Phillips et al. | 169/37 |
| 6,446,732 | B1 * | 9/2002 | Polan | 169/37 |
| 6,554,077 | B2 * | 4/2003 | Polan | 169/57 |
| 6,715,561 | B2 * | 4/2004 | Franson | 169/17 |
| 6,868,917 | B2 | 3/2005 | Meyer | |

(Continued)

*Primary Examiner* — Darren W Gorman
(74) *Attorney, Agent, or Firm* — Jeffrey Schox

(57) ABSTRACT

A fire sprinkler of the preferred embodiments includes a frame, a trigger, and a deflector. The frame defines a duct to exhaust the flow of a fire suppressing or extinguishing substance, and includes a fastener to fasten the frame to a supply line. The trigger blocks the flow of the fire suppressing or extinguishing substance through the duct during a first mode, and permits the flow of the fire suppressing or extinguishing substance during a second mode. The deflector redirects the flow of the fire suppressing or extinguishing substance into a coverage area. The deflector also at least partially shields the trigger from the dispersal of a fire suppressing or extinguishing substance from an adjacent fire sprinkler and prevents a failure of the trigger.

11 Claims, 4 Drawing Sheets

(56) References Cited

U.S. PATENT DOCUMENTS

| | | | | |
|---|---|---|---|---|
| 6,889,774 | B2 | 5/2005 | Multer | |
| 6,920,937 | B2 | 7/2005 | Neill | |
| 6,976,543 | B1 | 12/2005 | Fischer | |
| 2002/0096580 | A1 * | 7/2002 | Pahila | 239/498 |
| 2005/0045739 | A1 | 3/2005 | Multer | |
| 2006/0060361 | A1 * | 3/2006 | Pounder et al. | 169/37 |
| 2006/0070745 | A1 * | 4/2006 | Polan | 169/19 |
| 2007/0246231 | A1 * | 10/2007 | Pahila et al. | 169/37 |

* cited by examiner

FIRE SPRINKLER

CROSS-REFERENCE TO RELATED APPLICATIONS

This application is a continuation-in-part of international patent application number PCT/US2006/025278, filed on 27 Jun. 2006, and entitled "Fire Sprinkler", which is incorporated in its entirety by this reference.

This application is related to international patent application number PCT/US2006/025111, filed on 27 Jun. 2006, and entitled "Fire Sprinkler System and Method of Installation", which is incorporated in its entirety by this reference.

TECHNICAL FIELD

This invention relates generally to the fire suppression and extinguishment field, and more specifically to a new and improved fire sprinkler in the fire suppression and extinguishment field.

BACKGROUND

Fire sprinkler systems have been used in the United States to protect warehouses and factories for over one hundred years. In a fire sprinkler system, a fire sprinkler is positioned near the ceiling of a room where hot "ceiling jets" spread radially outward from a fire plume. When the temperature at an individual sprinkler reaches a pre-determined value, a thermally responsive element in the sprinkler activates and permits the flow of water as a water jet through a duct toward a deflector. The deflector redirects the water jet into thin streams or "ligaments" that break up into droplets due to surface tension. The water droplets serve three purposes: (1) delivering water to the burning material and reducing the combustion rate, (2) wetting the surrounding material and reducing the flame spread rate, and (3) cooling the surrounding air through evaporation and displacing air with inert water vapor.

When fire sprinklers are located close to each other, as shown in FIGS. 3 and 4, the risk of "cold soldering" becomes a concern. Cold soldering occurs when a first fire sprinkler disperses a fire suppressing or extinguishing substance that directly cools a second fire sprinkler and prevents the second fire sprinkler from properly responding and activating. Thus, there is a need in the fire suppression and extinguishment field to create an improved fire sprinkler that reduces or eliminates the risk of cold soldering. This invention provides such improved fire sprinkler.

DESCRIPTION OF THE PREFERRED EMBODIMENTS

The following description of the preferred embodiments of the invention is not intended to limit the invention to these preferred embodiments, but rather to enable any person skilled in the art of fire suppression and extinguishment to make and use this invention.

Figure 1:
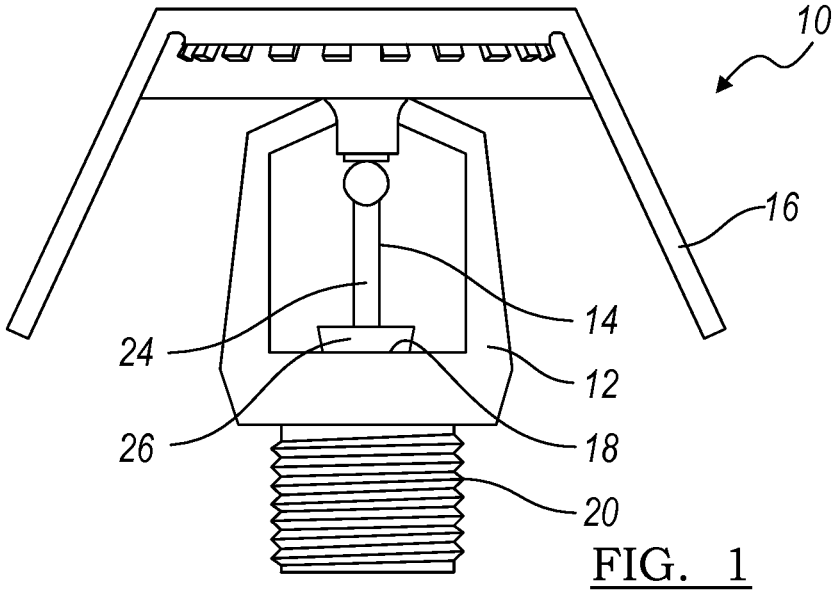
FIGS. 1 and 2 are different side views of the fire sprinkler according to the preferred embodiments.
Figure 2:
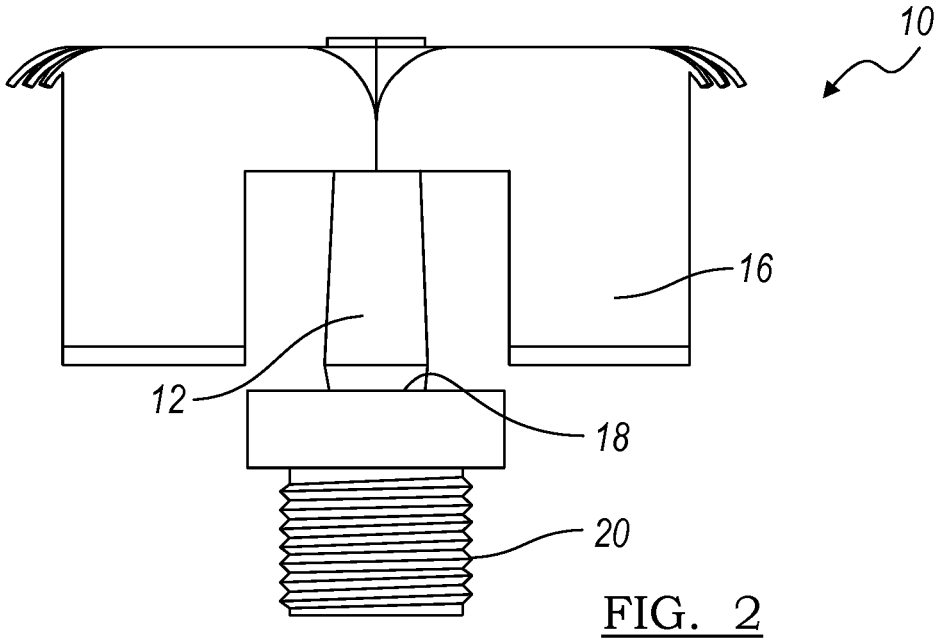

As shown in FIGS. 1 and 2, the fire sprinkler 10 of the preferred embodiments includes a frame 12, a trigger 14, and a deflector 16. The frame 12 defines a duct 18 to exhaust the flow of a fire suppressing or extinguishing substance, and includes a fastener 20 to fasten the frame 12 to a supply line. The trigger 14 blocks the flow of the fire suppressing or extinguishing substance through the duct 18 during a first mode, and permits the flow of the fire suppressing or extinguishing substance during a second mode. The deflector 16 redirects the flow of the fire suppressing or extinguishing substance into a coverage area. The deflector 16 also at least partially shields the trigger 14 from the dispersal of a fire suppressing or extinguishing substance from an adjacent fire sprinkler 10 and prevents a failure of the trigger 14.

Figure 3:
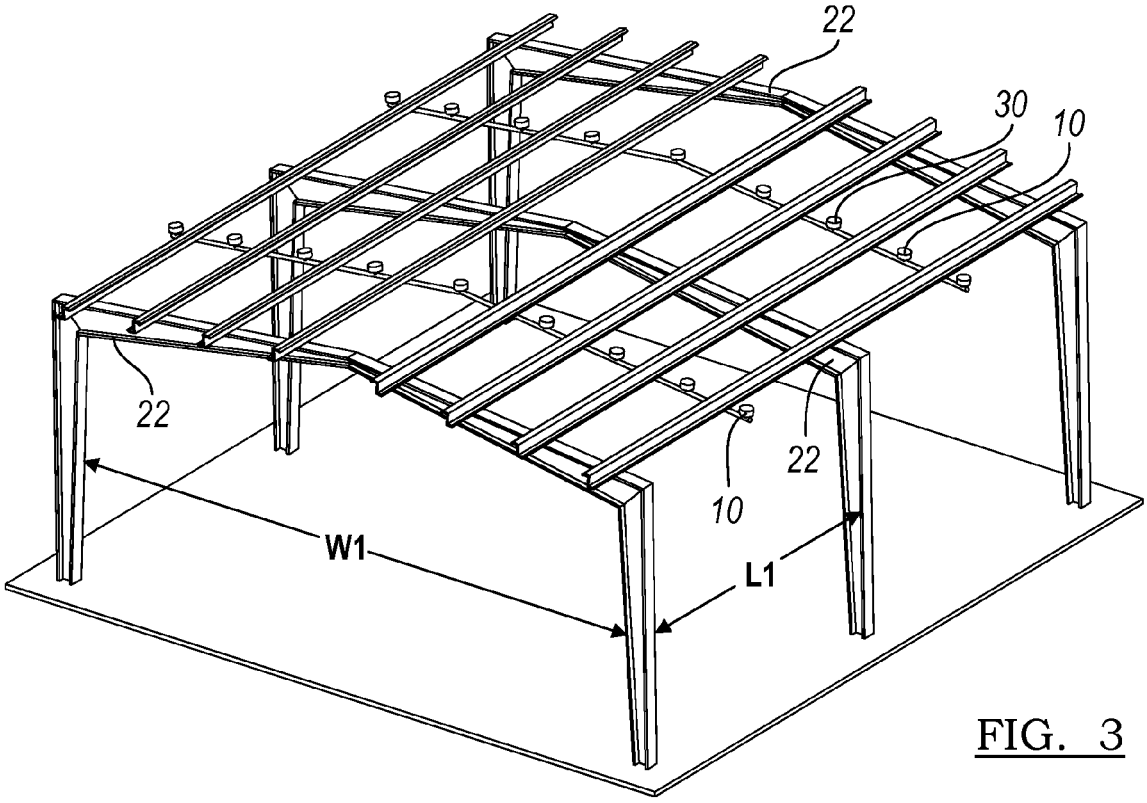
FIGS. 3 and 4 are perspective and overhead views, respectively, of the fire sprinkler system that incorporate the fire sprinkler according to the preferred embodiments.
Figure 4:
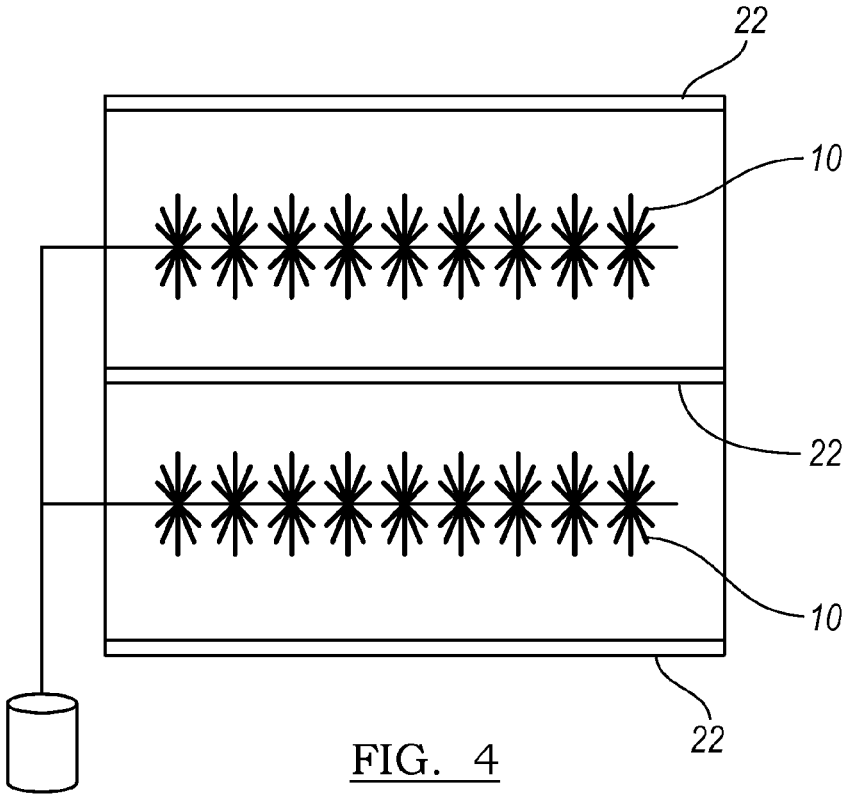

As shown in FIGS. 3 and 4, the fire sprinkler 10 of the preferred embodiments is preferably installed in a space having a width W1 of at least 20 feet (6 m) and a length L1 of at least 20 feet (6 m), and is more preferably installed in a space having a width of at least 20 feet (6 m) and a length of approximately 25 to 30 feet (7.5 m to 9 m). The space is preferably defined by two beams 22 extending along the width of the space and separated by a distance equal to the length of the space. The beams 22 function to support the weight of the roof (not shown). The beams 22 are preferably steel I-shaped rafters, but the beams 22 may be any suitable structural member to transfer the weight of the roof, may be made from any suitable material, and may be shaped in any suitable manner. Preferably, the fire sprinkler 10 is installed in a metal building, but the fire sprinkler 10 may alternatively be installed in any suitable shelter.

As shown in FIGS. 1 and 2, the frame 12 of the preferred embodiments functions to support the other elements of the fire sprinkler 10. The frame 12 preferably defines the duct 18 that functions to exhaust the flow of a fire suppressing or extinguishing substance. The duct 18 may include a nozzle or other suitable restriction. The frame 12 may, however, include any suitable method or device to exhaust the flow of a fire suppressing or extinguishing substance. The fire sprinkler 10 preferably includes a discharge k factor of 5.0 to 25, but may include a discharge k factor of any suitable number depending on the specific application of the fire sprinkler 10. The frame 12 preferably includes a fastener 20 (e.g., threads) that functions to fasten the frame 12 to a supply line. The supply line functions to supply a fire suppressing or extinguishing substance (e.g., water) to the fire sprinkler 10. The frame 12 may, however, include any suitable method or device to fasten the frame 12 to a supply line. The frame 12 is preferably made of metal, but may alternatively be made from any suitable material.

The trigger 14 of the preferred embodiments, which is connected to the frame 12, functions to block the flow of the fire suppressing or extinguishing substance through the duct 18 during a first mode, and to permit the flow of the fire suppressing or extinguishing substance during a second mode. The trigger 14 preferably includes a thermally responsive element 24 and a closure 26. During the first mode, the thermally responsive element 24 functions to restrain the closure 26, while the closure 26 functions to block the flow of the fire suppressing or extinguishing substance through the duct 18. During the second mode, the thermally responsive element 24 responds to the hot "ceiling jets" spreading radially outward from a fire plume and releases the closure 26, thereby permitting the flow of the fire suppressing or extinguishing substance. The thermally responsive element 24 is preferably a glass bulb, but may alternatively be a soldered link or any other suitable device or method. The trigger 14 may also include an o-ring, a Belleville spring, or any other suitable device between the thermally responsive element 24 and the frame 12. The trigger 14 may alternatively include any suitable method or device to block the flow of the fire suppressing or extinguishing substance through the duct 18 during a first mode, and to permit the flow of the fire suppressing or extinguishing substance during a second mode.

Figure 5:
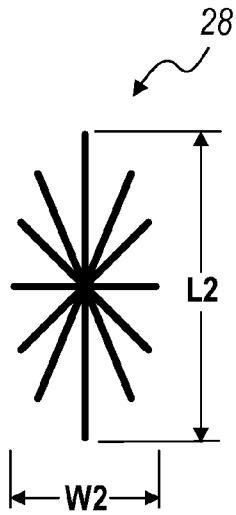
FIG. 5 is a detailed view of the coverage area of the fire sprinkler according to the preferred embodiments.

As shown in FIG. 5, the deflector of the preferred embodiments, which is connected to the frame, functions to redirect the flow of the fire suppressing or extinguishing substance into a coverage area 28 having a length L2 and a width W2. Preferably, the width W2 of each coverage area 28 is less than the length L2 of each coverage area 28. In a first variation, the width W2 of each coverage area 28 is less than 66% of the length L2 of each coverage area 28. In a second variation, the width W2 of each coverage area 28 is less than 33% of the length L2 of each coverage area 28. In a third variation, the length L2 of each coverage area 28 is at least 20 feet (6 m) and the width W2 of each coverage area 28 is approximately 5 to 6 feet (1 to 2 m). In alternative variations, the length L2 and the width W2 of each coverage area may be any suitable dimension.

When the fire sprinkler 10 is located close to an adjacent fire sprinkler 30 (as shown in FIGS. 3 and 4), the dispersal of a fire suppressing or extinguishing substance from the adjacent fire sprinkler 30 may directly cool the fire sprinkler 10 and prevent the trigger 14 from properly responding to the fire and releasing the closure 26. As shown in FIGS. 1 and 2, the deflector 16 of the preferred embodiments also functions to reduce or eliminate this risk. Preferably, the deflector 16 accomplishes this function by at least partially shielding the trigger 14 from the dispersal of a fire suppressing or extinguishing substance from the adjacent fire sprinkler 30. Given that the duct 18 defines a first direction for the flow of the fire suppressing or extinguishing substance and the thermally responsive element 24 extends along this first direction, the deflector 16 preferably extends in a second direction, which is opposite the first direction, past at least a portion of the thermally responsive element 24. More preferably, as shown in FIG. 1, the deflector 16 extends in the second direction completely past the thermally responsive element 24. Alternatively, the deflector 16 may accomplish the function of reducing or eliminating the risk of cold soldering in any suitable method or design.

Figure 6:
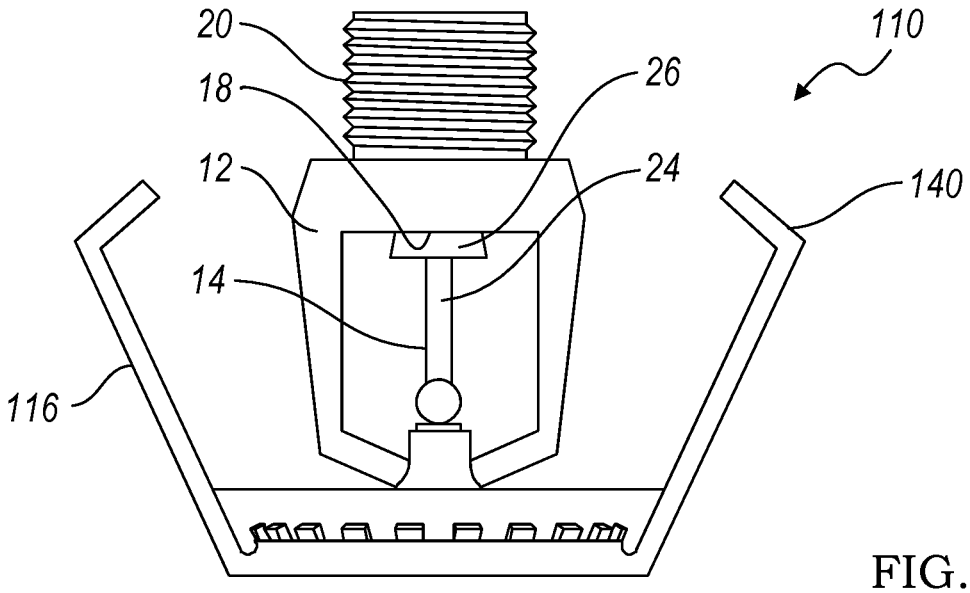
FIGS. 6 and 7 are side views of the fire sprinklers according to a first variation and a second variation, respectively, of the preferred embodiments.

As shown in FIG. 6, the fire sprinkler 110 of a first variation of the preferred embodiments is arranged as a pendant-type sprinkler, instead of an upright-type sprinkler. The fire sprinkler 110 of the first variation preferably includes the same components as the fire sprinkler 10 with the exception of the deflector 116. The deflector 116 preferably includes an inwardly bent portion 140 that further aids in shielding the trigger 14 from the dispersal of a fire suppressing or extinguishing substance from the adjacent fire sprinkler 30.

Figure 7:
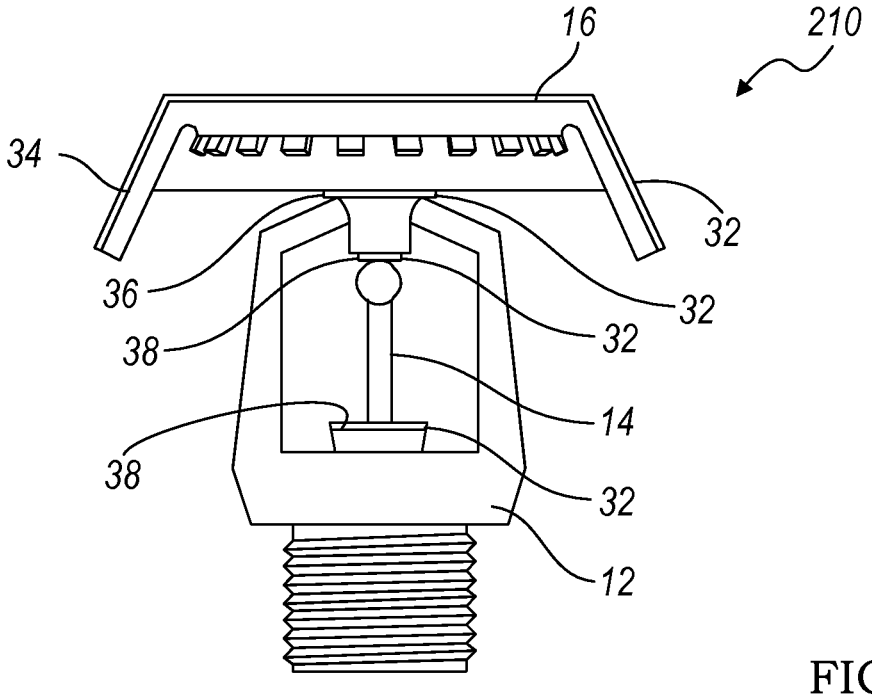

As shown in FIG. 7, the fire sprinkler 210 of a second variation of the preferred embodiments also includes one or more thermal insulators 32. The thermal insulator 32 functions to further reduce or eliminate the risk of cold soldering. Preferably, the thermal insulator 32 accomplishes this function by reducing or eliminating heat transfer from the trigger 14, through the frame 12, through the deflector 16, and into a fire suppressing or extinguishing substance dispersed onto the deflector 16. The thermal insulator 32 may be placed in several different locations on the fire sprinkler 210. In a first variation, the thermal insulator 32 is a coating 34 on the exterior surface of the deflector 16. The coating 34 is preferably a ceramic or silicon based material, but may be any suitable material to reduce or eliminate heat transfer between the deflector 16 and the fire suppressing or extinguishing substance dispersed onto the deflector 16. In a second variation, the thermal insulator 32 is a deflector coupling 36 between the deflector 16 and the frame 12. The deflector coupling 36 is preferably an insert made of rubber or silicon based material, but may be any suitable device made of any suitable material to reduce or eliminate heat transfer between the frame 12 and the deflector 16. In a third variation, the thermal insulator 32 is a trigger coupling 38 between the trigger 14 and the frame 12. The trigger coupling 38 is preferably one or more bushings made of rubber or silicon based material located at either or both ends of the trigger 14, but may be any suitable device made of any suitable material to reduce or eliminate heat transfer between the trigger 14 and the deflector 16.

Figure 8:
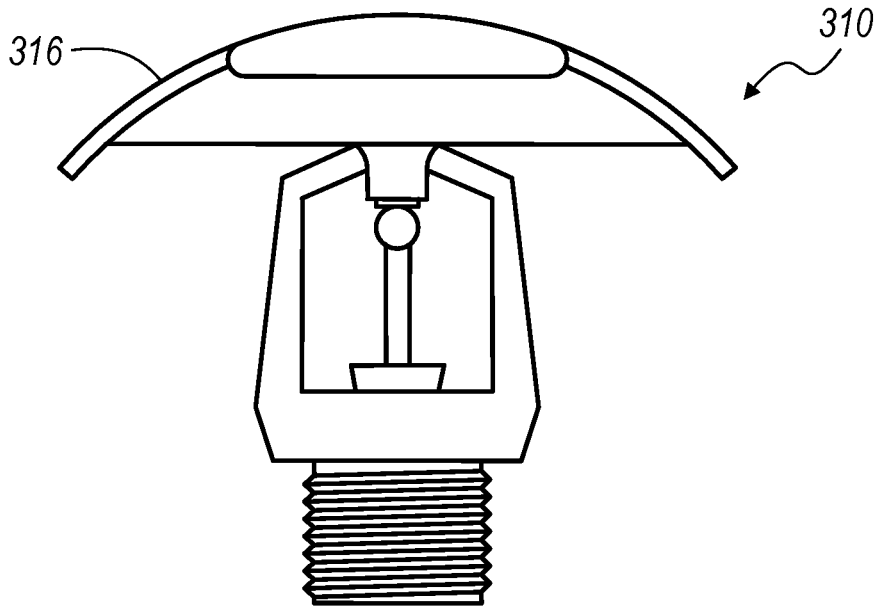
FIGS. 8 and 9 are different side views of the fire sprinkler according to a third variation of the preferred embodiment.
Figure 9:
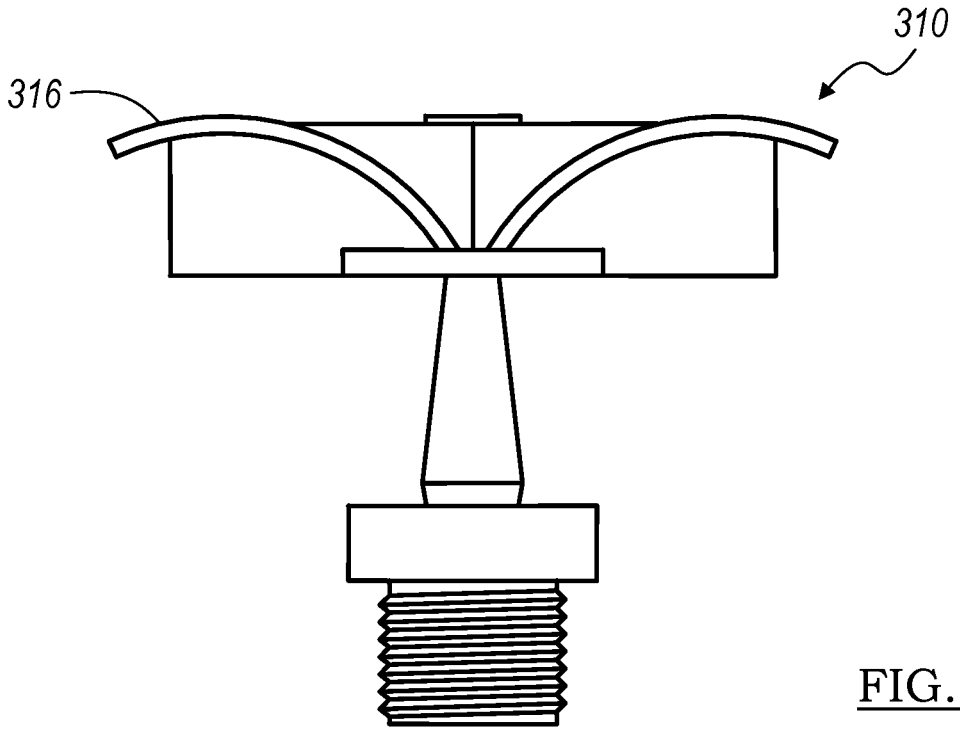

As shown in FIGS. 8 and 9, the fire sprinkler 310 of a third variation of the preferred embodiments includes a modified deflector 316, but otherwise preferably includes the same components as the fire sprinkler 10. Like the deflector 16, the modified deflector 316 redirects the flow of the fire suppressing or extinguishing substance into a coverage area and at least partially shields the trigger 14 from the dispersal of a fire suppressing or extinguishing substance from an adjacent fire sprinkler 10 and prevents a failure of the trigger 14. The modified deflector 316, however, includes a complex curvature defining a first pair of adjacent arcs in one direction and second pair of adjacent arcs in a perpendicular direction. All four arcs preferably originate near the center of the flow of a fire suppressing or extinguishing substance. The first pair of adjacent arc redirects the flow of the fire suppressing or extinguishing substance in the direction of the width (or the "short" side) of the coverage area 28, while the second pair of adjacent arcs redirects the flow of the fire suppressing or extinguishing substance in the direction of the length (or the "long" side) of the coverage area 28. The geometries of the arcs (e.g., the height, length, and curvature) are preferably chosen based on the specific application and environment of the sprinkler (e.g., the flow rate of the fire suppressing or extinguishing substance, the distance and height of storage containers in the proximity of the sprinkler, and other suitable factors).

As a person skilled in the art of fire suppression and extinguishment will recognize from the previous detailed description and from the figures and claims, modifications and changes can be made to the preferred embodiments of the invention without departing from the scope of this invention defined in the following claims.

I claim:

1. A fire sprinkler comprising:

a frame defining a duct adapted to exhaust the flow of a fire suppressing or extinguishing substance, and having a fastener adapted to fasten the frame to a supply line;

a trigger coupled to the frame and adapted to block the flow of the fire suppressing or extinguishing substance through the duct during a first mode and to permit the flow of the fire suppressing or extinguishing substance during a second mode; and a deflector coupled to the frame and comprising:

a first pair of arcs extending in opposite directions from a central portion, the first pair of arcs curving toward the trigger; and a second pair of arcs extending in opposite directions from the central portion, the second pair of arcs perpendicular to the first pair of arcs;

wherein the first and second pair of arcs cooperate to redirect the flow of the fire suppressing or extinguishing substance into an elliptical spray pattern that covers an elliptical coverage area having a length, a width, a first axis of symmetry extending along the length of the coverage area, and a second axis of symmetry extending along the width of the coverage area, wherein the width of the coverage area is substantially less than the length of the coverage area.

2. The fire sprinkler of claim 1, wherein the trigger includes a thermally responsive element.

3. The fire sprinkler of claim 2, wherein the thermally responsive element includes a glass bulb.

4. The fire sprinkler of claim 2, wherein the trigger further includes a closure.

5. The fire sprinkler of claim 1, wherein the width of the coverage area is less than 33% of the length of the coverage area.

6. The fire sprinkler of claim 1, wherein the length of the coverage area is at least 6 m, and wherein the width of the coverage area is approximately 1 to 2 m.

7. The fire sprinkler of claim 1, wherein the width of the coverage area is non-zero and less than 33% of the length of the coverage area.

8. The fire sprinkler of claim 1, wherein the deflector further comprises a thermally insulative coating selected from the group consisting of ceramic-based insulation and polymer-based insulation.

9. The fire sprinkler of claim 8, wherein the deflector includes an interior surface facing inward toward the trigger and an exterior surface facing outward from trigger, and wherein the thermally insulative coating is a coating on the exterior surface of the deflector.

10. The fire sprinkler of claim 1, wherein the length of the coverage area is at least 6 m, and wherein the width of the coverage area is approximately 1 to 2 m.

11. A fire sprinkler comprising:

a frame defining a duct adapted to exhaust the flow of a fire suppressing or extinguishing substance, and having a fastener adapted to fasten the frame to a supply line;

a trigger coupled to the frame and adapted to block the flow of the fire suppressing or extinguishing substance through the duct during a first mode and to permit the flow of the fire suppressing or extinguishing substance during a second mode; and a deflector coupled to the frame and comprising:

a first pair of substantially symmetric, curved arcs extending in opposite directions from a central portion, the first pair of arcs curving toward the trigger, each arc of the first pair having a first curvature; and a second pair of substantially symmetric, curved arcs extending in opposite directions from the central portion, the second pair of arcs perpendicular to the first pair of arcs across the central portion, the second pair of arcs extending away from the trigger, each arc of the second pair having a second curvature different from the first curvature;

wherein the first and second pair of arcs cooperate to redirect the flow of the fire suppressing or extinguishing substance into an elliptical spray pattern that covers an elliptical coverage area having a length, a width, a first axis of symmetry extending along the length of the coverage area, and a second axis of symmetry extending along the width of the coverage area, wherein the width of the coverage area is substantially less than the length of the coverage area.

* * * * *